US007486841B2

(12) United States Patent
Gallant

(10) Patent No.: US 7,486,841 B2
(45) Date of Patent: Feb. 3, 2009

(54) PUZZLE MACHINE AND METHOD OF OPERATING SAME

(75) Inventor: Paul Gallant, Montreal (CA)

(73) Assignee: Hasbro, Inc., Pawtucket, RI (US)

( * ) Notice: Subject to any disclaimer, the term of this patent is extended or adjusted under 35 U.S.C. 154(b) by 671 days.

(21) Appl. No.: 11/105,801

(22) Filed: Apr. 14, 2005

(65) Prior Publication Data

US 2005/0230909 A1 Oct. 20, 2005

(30) Foreign Application Priority Data

Apr. 14, 2004 (CA) ..... 2464591

(51) Int. Cl.
*G06K 9/00* (2006.01)
*A63F 7/04* (2006.01)

(52) U.S. Cl. ..... 382/284; 273/153 R

(58) Field of Classification Search ..... 382/284, 382/312; 273/153 R, 156, 157 R, 159; 83/861; 156/250–254
See application file for complete search history.

(56) References Cited

U.S. PATENT DOCUMENTS

| | | | | |
|---|---|---|---|---|
| 2,089,225 | A | 8/1937 | Polachek | |
| 2,328,281 | A | 8/1943 | Jones | |
| 2,737,238 | A | 3/1956 | Rowlands | |
| 3,854,726 | A | 12/1974 | Balder | |
| 3,949,928 | A * | 4/1976 | Perkins | 229/185.1 |
| 4,336,664 | A * | 6/1982 | Penick et al. | 40/594 |
| 4,408,221 | A | 10/1983 | McCoy | |
| 4,417,791 | A | 11/1983 | Erland et al. | |
| 4,586,714 | A * | 5/1986 | Lenkoff et al. | 273/157 R |
| 4,735,417 | A * | 4/1988 | Gould | 273/153 S |
| 4,824,112 | A * | 4/1989 | Roy | 273/157 R |
| 5,251,900 | A * | 10/1993 | Gallant | 273/157 R |
| 5,517,776 | A * | 5/1996 | Knappe et al. | 40/753 |
| 5,577,728 | A | 11/1996 | Kondo | |

(Continued)

FOREIGN PATENT DOCUMENTS

| | | |
|---|---|---|
| CA | 2320584 | 10/2001 |

(Continued)

OTHER PUBLICATIONS

Puzzle Clonz(R)—Computer Printable Jigsaw Puzzles! Copyright 1998 http://www.compozapuzzle.com/jigsaw-puzzle-clonzz.htm Copyright 1998/2004 ref: patent No. 5,988,687.

(Continued)

*Primary Examiner*—Kanji Patel
(74) *Attorney, Agent, or Firm*—Perry Hoffman

(57) ABSTRACT

A method and apparatus for producing a customized jigsaw puzzle is disclosed. The apparatus comprises an image capturing mechanism, such as a camera, that captures one or more images of one or more individuals, animals, or objects or combinations of these posed against a background. A computer that is linked to the mechanism and to a printer is programmed to print an image on flexible sheets having a printable surface. Then a press, having a platen carrying a jigsaw puzzle cutting die, when activated uses pressure to laminate together the flexible sheet bearing the printed image and a foam sheet thicker and more rigid than he flexible sheets, setting pressure responsive adhesive material used as a binder to form a laminated product, and substantially simultaneously to cut the laminated product into jigsaw puzzle pieces.

12 Claims, 11 Drawing Sheets

U.S. PATENT DOCUMENTS

| | | | | |
|---|---|---|---|---|
| 5,605,332 | A | 2/1997 | Harnett | |
| 5,865,928 | A * | 2/1999 | Lariviere et al. | 156/256 |
| 5,957,454 | A | 9/1999 | Libeskind | |
| 5,988,687 | A | 11/1999 | Kirsch | |
| 6,148,148 | A | 11/2000 | Wain et al. | |
| 6,441,865 | B1 | 8/2002 | Hailey | |
| 6,517,071 | B2 * | 2/2003 | Gallant | 273/157 R |
| 6,565,089 | B1 * | 5/2003 | Matos | 273/157 R |
| 6,663,732 | B1 | 12/2003 | Link | |
| 2004/0228989 | A1 | 11/2004 | Abramek | |

FOREIGN PATENT DOCUMENTS

| | | | |
|---|---|---|---|
| EP | 0696464 | A1 | 2/1996 |
| EP | 1147908 | A2 | 10/2001 |
| FR | 2653350 | A1 | 4/1991 |
| GB | 2116478 | A | 9/1983 |
| JP | 05-285272 | | 11/1993 |
| JP | 07-194840 | | 8/1995 |
| JP | 10-137441 | | 5/1998 |
| JP | 10-235009 | | 9/1998 |
| JP | 11-004961 | | 1/1999 |
| JP | 11-262576 | | 9/1999 |
| JP | 2002-224429 | | 8/2002 |
| JP | 2002-245545 | | 8/2002 |
| WO | WO 9842420 | A1 | 10/1998 |
| WO | WO 00/38925 | | 7/2000 |

OTHER PUBLICATIONS

PCT/CA2005/000562—International Search Report. dated Aug. 9, 2005.

PCT/CA2005/000562—Written Opinion of the International Searching Authority. dated Aug. 9, 2005.

PCT/CA2005/000562—Notification of Transmittal of the International Search Report and the Written Opinion of the International Searching Authority or the Declaration.Aug. 9, 2005.

Bob Armstrong, Earliest Use of Special Techniques for Jigsaw Puzzles, www.oldpuzzles.com/earliest_uses, (Games & Puzzle Collectors Quarterly, vol. 3:Nos. 1-3, 2002).

Seagull Scientific, Getting Started Using BarTender and Seagull Printer Drivers (Version 01.08.10.14.47, English Edition, 2001).

Hallogram Publishing, Introduction to the BarTender Software at http://www.hallogram.com/barcodes/bartendr/tutorial.html (2003).

* cited by examiner

PUZZLE MACHINE AND METHOD OF OPERATING SAME

BACKGROUND OF THE INVENTION

1. Field of the Invention

The invention relates generally to the field of puzzles, and more particularly to the manufacture of customized jigsaw puzzles.

2. Description of the Related Art

Public photographic vending machines are well known in the prior art. These machines typically include cameras which can take photographs of individuals sitting in the machine or booth. These photographs are developed by the machine and dispensed to the individual. More modern photographic vending machines include systems that are able to produce a photographic montage using an image of the user in combination with a stored image selected by the user.

There is consumer interest in personalized jigsaw puzzles which include an image or a modified image chosen by the consumer. For example, French patent application FR 2,653,350 (published Apr. 26, 1991) describes a process for creating a jigsaw puzzle from a photograph. The photograph is glued to a cardboard sheet, and then the photograph and the cardboard sheet are pressed together and then are cut into pieces to form a jigsaw puzzle. Unfortunately, the production of individual cardboard jigsaw puzzles is generally not economically feasible, primarily due to equipment costs, as such puzzles are mass-produced and cut using giant industrial presses. A flourishing business still exists for hand-cut personal and custom puzzles, as is evidenced by various web sites that offer this service. These mainly use photographs glued to plywood that is then cut with either scroll saws or water jets.

WO 98/42420 (Japanese published Oct. 1, 1998) describes a jigsaw puzzle constructing vending machine. The machine captures a picture of an individual and permits the picture to be combined with a selected background. It may be overlaid with text, and morphing and retouching are suggested. The modified picture is then printed onto cardboard. The central portion of the cardboard is then cut out, leaving a surrounding cardboard frame, and the central portion is cut into puzzle pieces having curved but non-interlocking borders. The puzzle pieces are then dispensed. The surrounding cardboard frame is mounted on a backing and is dispensed separately, so that the cardboard pieces may be assembled within the frame by a child. Examples of materials to be used for the jigsaw puzzle sheet are listed and include paper (cardboard), wood (stain sheets), synthetic resins (soft and hard material), synthetic material, stone materials, woven fabrics, non-woven fabrics, cork, metals, leather and glass.

SUMMARY OF THE INVENTION

In at least one of the described embodiments, the invention relates to a method and apparatus for producing a customized jigsaw puzzle. The apparatus comprises an image capturing mechanism, such as a camera, that captures one or more images of one or more individuals, animals, or objects or combinations of these posed against a background. A computer that is linked to the mechanism and to a printer is programmed to print an image on flexible sheets having a printable surface. Then a press, having a platen carrying a jigsaw puzzle cutting die, when activated uses pressure to laminate together the flexible sheet bearing the printed image and a foam sheet thicker and more rigid than he flexible sheet, setting pressure responsive adhesive material used as a binder to form a laminated product, and substantially simultaneously to cut the laminated product into jigsaw puzzle pieces. Additionally, the apparatus may be provided for producing a custom puzzle using selecting means for selecting a first digital image containing at least two layers of images, within a bank of digital images and digital image capturing means for capturing a second digital image of subject individuals, animals, or objects. Further image processing means provide for integrating the second digital image between the at least two layers of the first digital image to obtain a composite image and puzzle production means for producing the custom puzzle with the digital composite image.

DETAILED DESCRIPTION OF THE EMBODIMENTS

Figure 1:
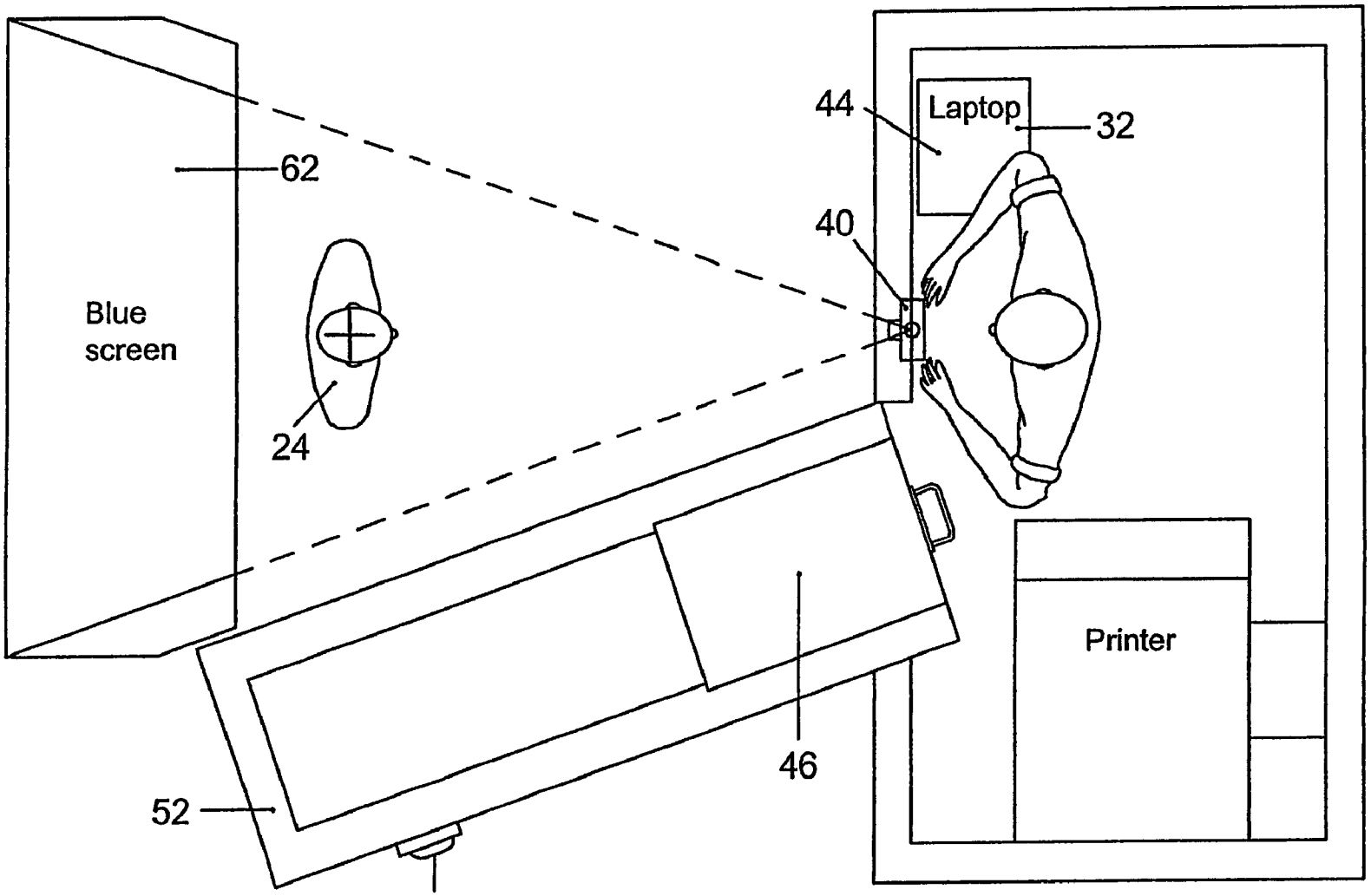
FIG. 1 is a plan view of a site showing a jigsaw puzzle machine designed in accordance with an embodiment of the invention in relation to a person or other subject that is to be photographed.

Referring to FIGS. 1, 2, 3, 4, 6, 7, and 13, a jigsaw puzzle machine 20 (FIG. 13) is disclosed. The jigsaw puzzle machine 20 can produce a custom jigsaw puzzle 30 (FIG. 7) for a user from a composite image 22 (FIGS. 4 and 13) that is a combination of an image of a subject person 24 (FIGS. 1 and 3—the subject may also be a pet or a toy or some other object) with at least one stored image 34 (FIG. 2), the composite image 22 being shown in FIG. 4.

Figure 2:
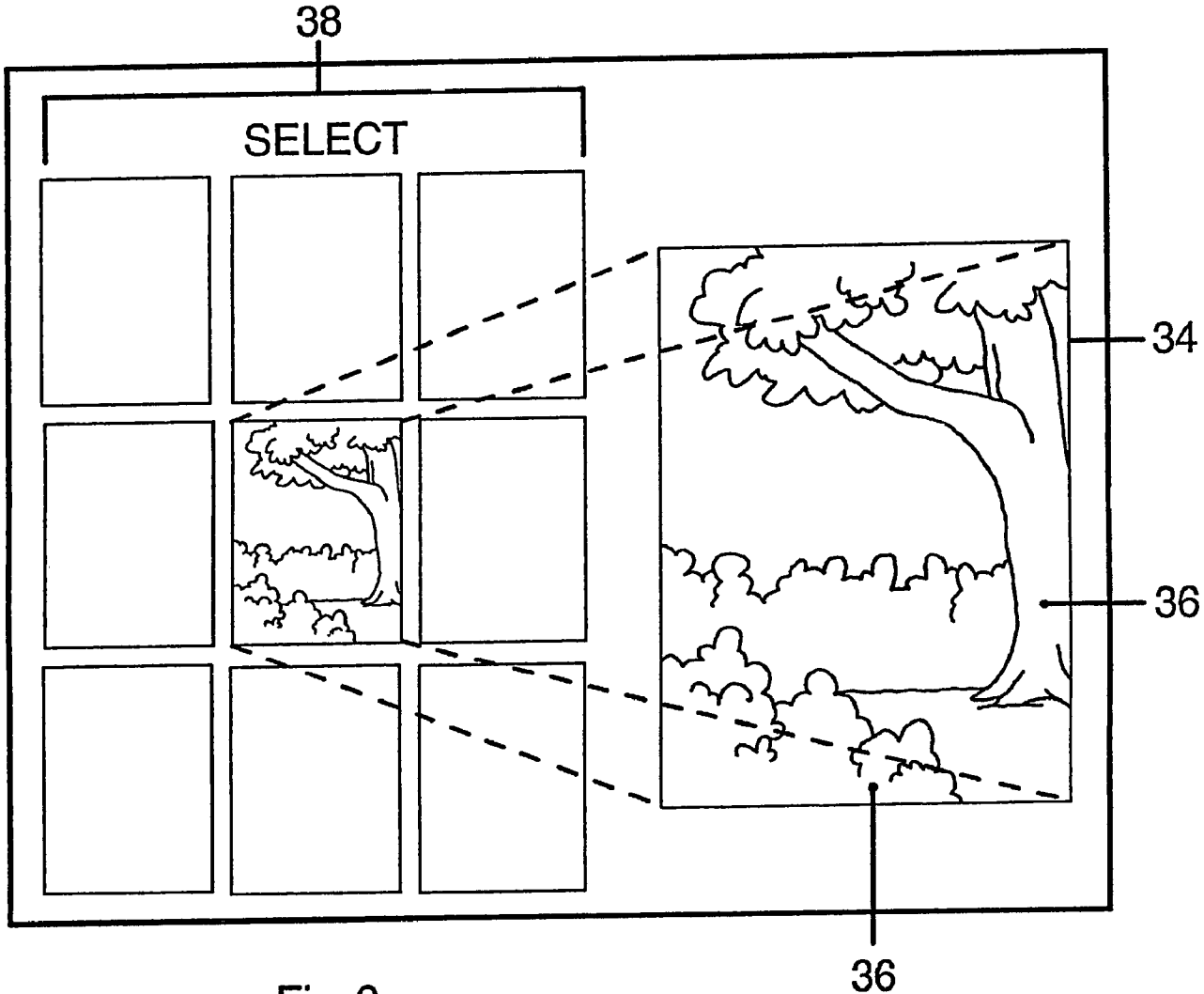
FIG. 2 shows a schematic view of a screen shot of a computer screen, according to an embodiment of the invention, illustrating the selection of a background scene for use in the design of a jigsaw puzzle.
Figure 4:
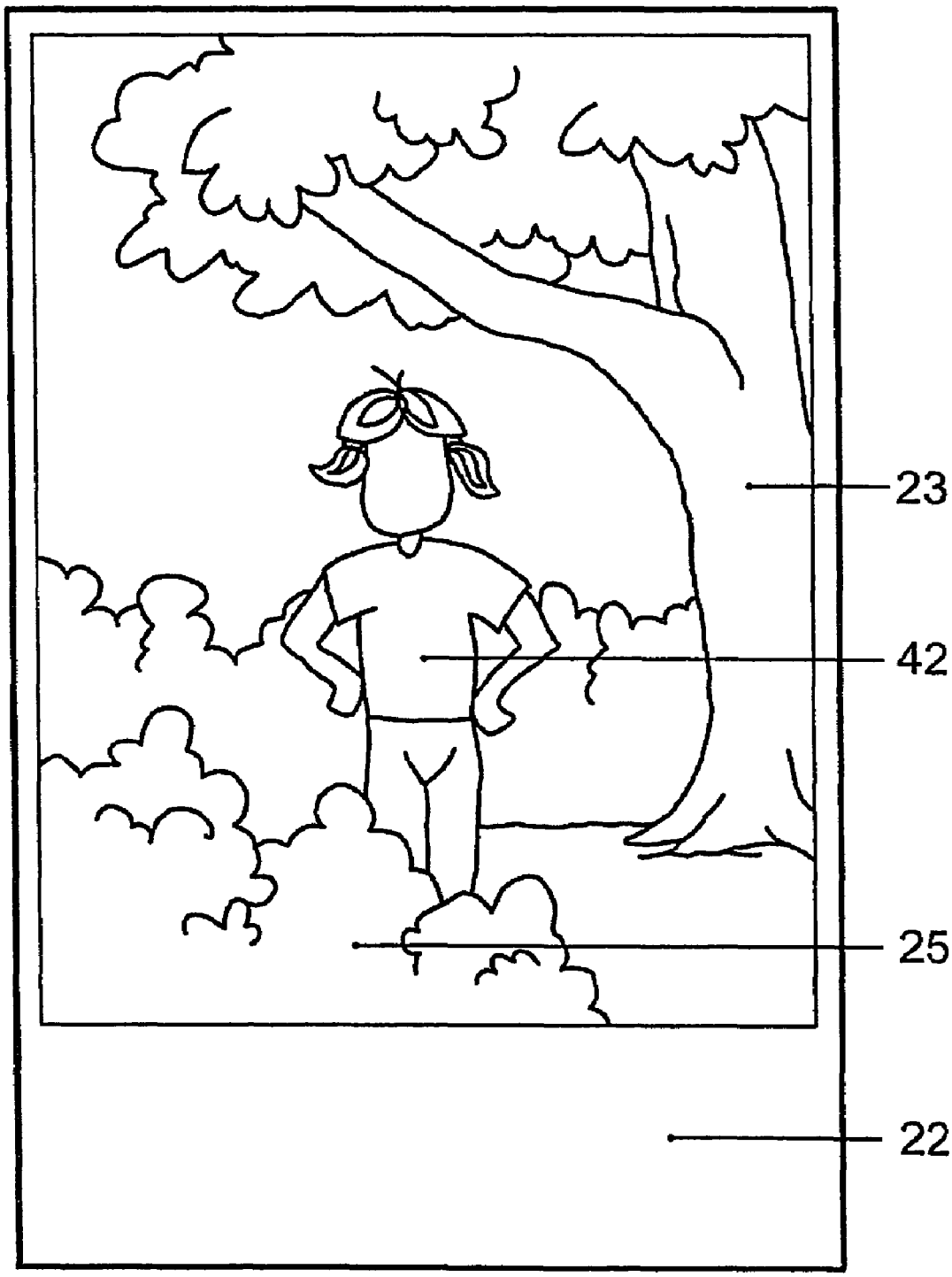
FIG. 4 shows a schematic view of a screen shot of a computer screen, in accordance with an embodiment of the invention, illustrating the construction of a composite image having three layers.
Figure 13:
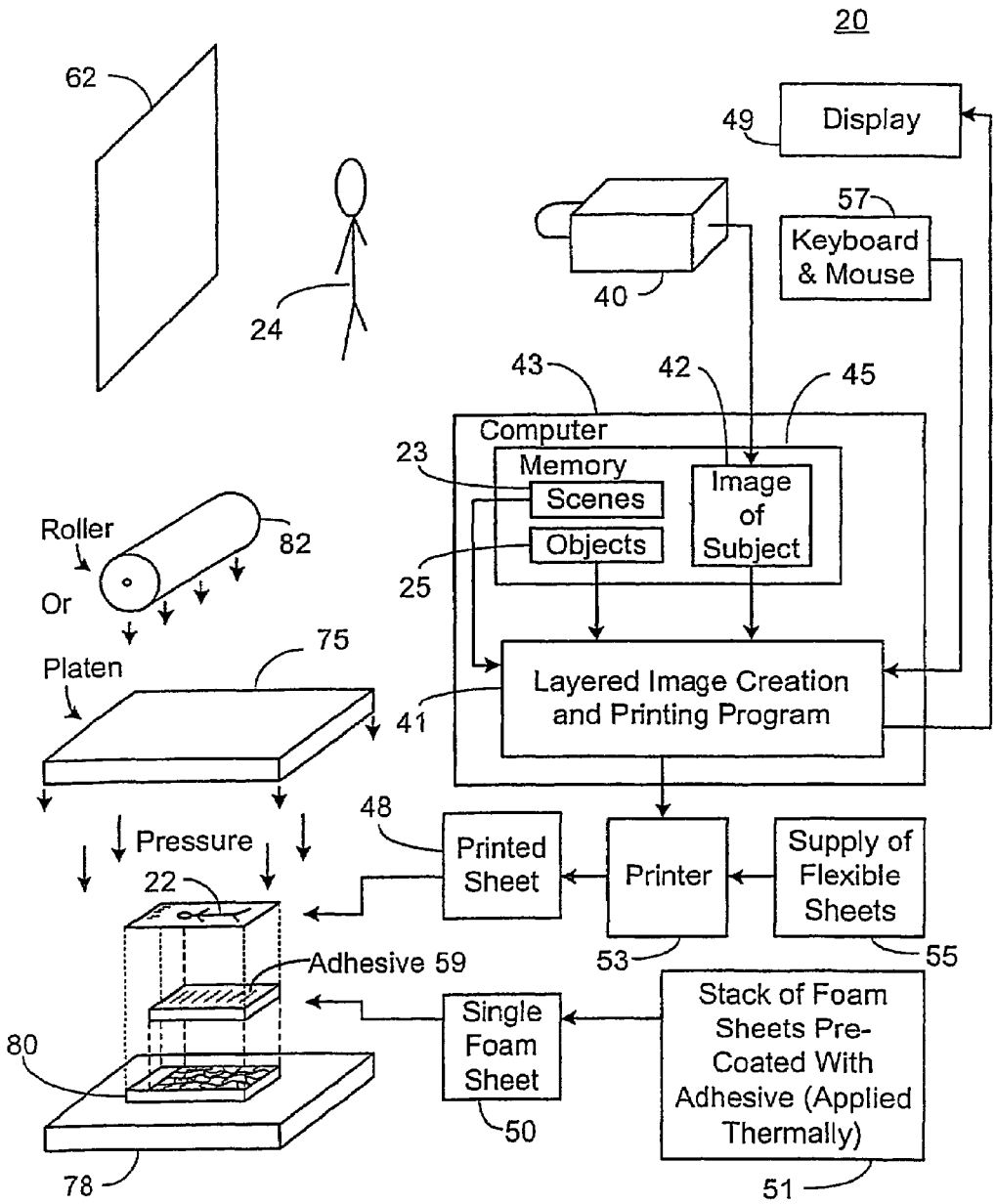
FIG. 13 presents a schematic flow diagram of the entire process of producing customized puzzles, with many elements represented by block diagrams.

More particularly, the present invention is embodied in a jigsaw puzzle machine 20 which includes a programmed computer 43 that permits one to select a first digital stored image 34 containing at least two layers of images 36, including background scenes 23 and foreground objects 25 (as shown in FIGS. 2 and 13), within a bank of digital images 38. The machine 20 further includes digital image capturing means 40 (such as a camera or scanner or data port) for capturing a second digital image 42 of a person or other subject 24. The machine 20 also includes image processing means 44 implemented using a computer 43 programmed with a layered image creation and printing program 41 for integrating the second digital image 42 between the at least two layers 36 of the first digital stored image 34 to obtain a composite image 22 (as shown in FIG. 4). The machine 20 also includes puzzle production means 46 (FIG. 1) for producing the custom jigsaw puzzle 30 bearing the digital composite image 22. Included in the puzzle production means 46, and with reference to FIG. 13, are a printer 53 which prints the composite image 22 onto a flexible sheet 48, a puzzle cutting die 80 resting on a surface 78, and either a platen 78 or a roller 82 arranged to apply pressure to laminate the printed flexible sheet 48 on to a foam backing sheet 50 that is pre-coated with adhesive 59. and to cut the laminated sheets into a jigsaw puzzle. The puzzle production means 46 also includes a stack of the foam sheets 51 and a supply of the flexible sheets 55 that feeds the printer 53, as is shown in FIG. 13.

Figure 7:
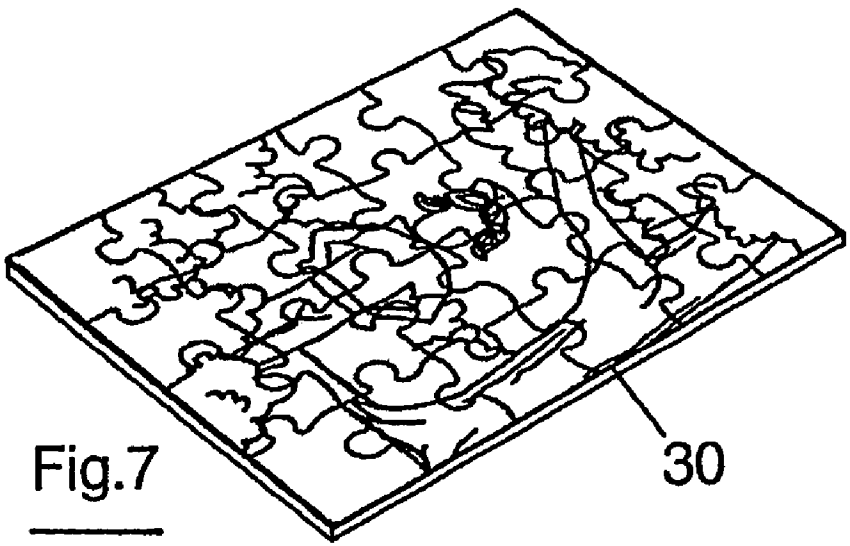
FIG. 7 is a perspective view of a jigsaw puzzle resulting after pressure is applied to set the adhesive and to force a puzzle die against the laminated sheets to cut them into puzzle pieces.

A programmed computer 43 and a program 41 to assist one in selecting a first digital stored image 34 within a bank of digital images 38 cooperate with digital image capturing means 40 (such as a camera or photograph scanner or computer port for receiving digital image data from a camera or portable storage device or camera) which captures a second digital image 42 of a person or other subject 24. Image processing means 44 in the form of a layered image creation and printing program 41 (such as Adobe's® Photoshop®) enable an operator to integrate the second digital image 42 into the first digital stored image 34 to produce a composite image 22 that may be printed on a flexible sheet 48. Jigsaw puzzle production means 46 (see FIGS. 1 and 13) including the printer 53 and an apparatus for producing pressure (either platens 76 and 78 or the platen 78 and a roller 82 shown in FIG. 13) that laminates the sheet 48 onto a sheet 50 made of foam and that causes a puzzle die 80 to cut the laminated sheets 48 and 50 into puzzle pieces to produce the puzzle 30 (FIG. 7).

Figure 6:
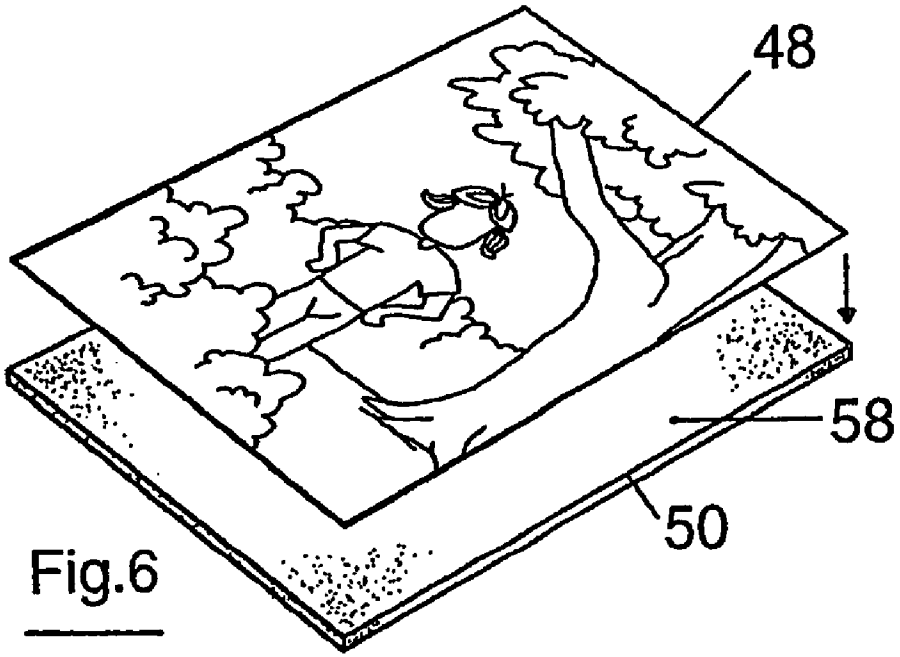
FIG. 6 presents a perspective view of a first flexible sheet bearing a puzzle picture being placed upon the pre-glued surface of a second sheet made of foam, in accordance with an embodiment of the invention.

The first sheet 48, when pressure is applied, becomes attached to an adhesive coated 59 surface of the second sheet 50 which is made of foam (as is shown in FIG. 6). The foam sheets are pre-coated with the adhesive and are heated to set the adhesive, since the adhesive is thermally activated. The pre-coated sheets of foam are then stacked at 51 for convenient storage before use.

The image processing means 44 may include a memory 45 in which are stored pre-established parameters upon which the integrating of the images is based. It also includes a computer 43 provided with a keyboard and mouse 57 and a display 49 and programs 41 that can display the layered images and permit the operator to manipulate the composite image 22 and its layered elements 36 and 42.

Figure 9:
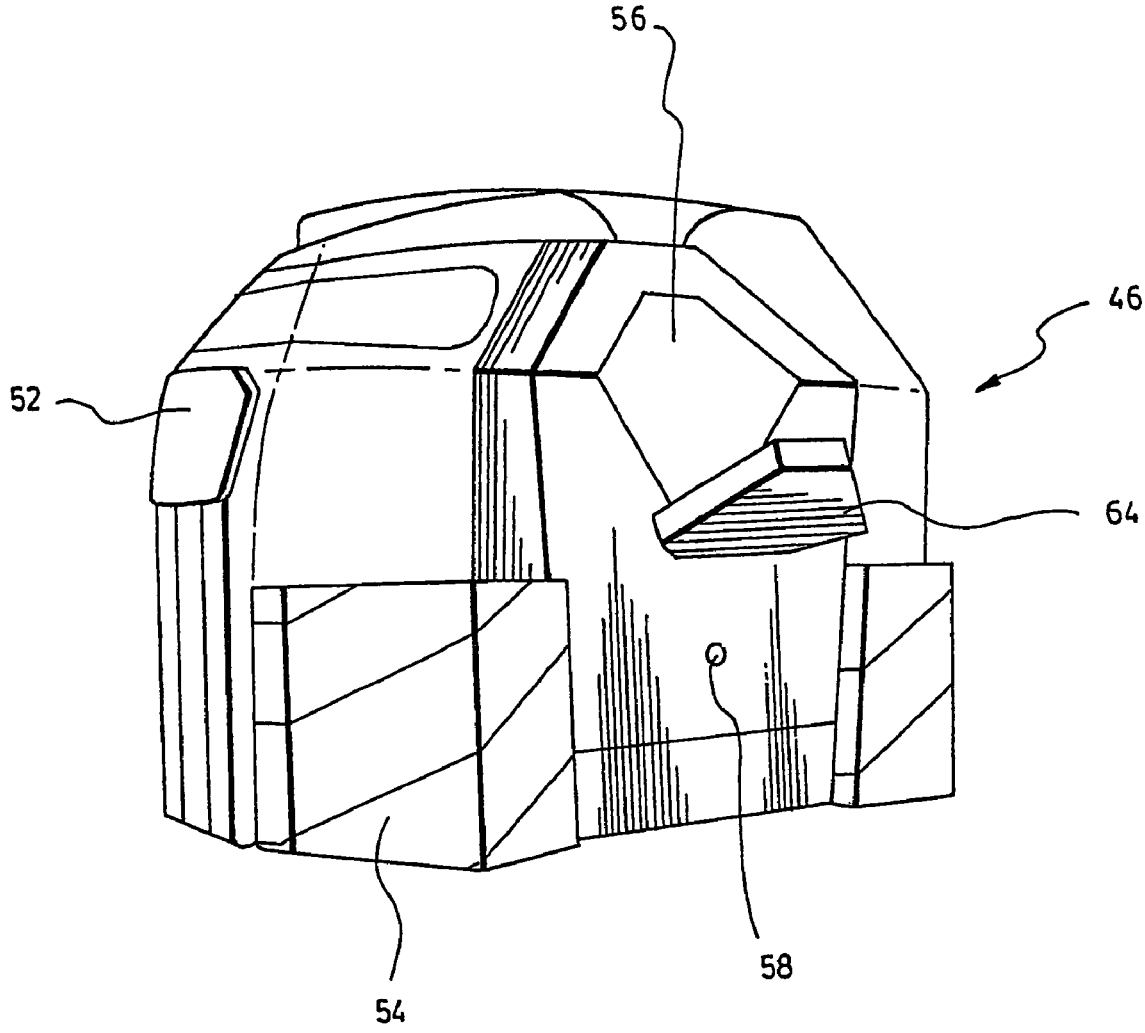
FIG. 9 is a perspective view of a part of a jigsaw puzzle machine designed according to an alternate embodiment of the invention different from that shown in FIG. 1.

Referring to FIG. 9, the jigsaw puzzle machine 20 in one embodiment (different from that shown in FIG. 1) may have an external housing 52 that covers the jigsaw puzzle production means 46, the external housing 52 including movable parts 54 (to entertain any children) and an exit 56. The jigsaw puzzle machine may also include a motor for moving the movable parts 54, a sound generator for generating interesting machine sounds, a conveyer that conveys the finished custom jigsaw puzzle 30 from inside of the housing 52 to the waiting child or adult through the exit 56, and a button 58 for activating the motor, the sound generator and the conveyer from outside of the housing 52. In an embodiment of the invention, the housing 52 is modular and takes only 3 hours to assemble. A child goes to the housing 52 and presses a button 58 that triggers the production process during which some parts 54 at the base of the housing 52 move about while making machine sounds. In an embodiment of the invention, a small door 64 opens on one side of the jigsaw puzzle production means 46, and a sound can be heard as packaging containing the custom jigsaw puzzle 30 is dropped through the opening 56. The whole jigsaw puzzle production process can be accomplished within a relatively short period of time, in the order of minutes.

Referring to FIG. 6, the foam sheet 50 may be made of a polyethylene foam having a thickness of at least 3 mm (non-toxic polyethylene foam or foam for a Perfalock™ System). The foam may be LD60, weighing 2.5 pounds per square meter when the sheets are 3 millimeters thick. The puzzle is cut out of an 11 inch by 17 inch sheets. In the case of the thin, flexible sheets 48, he grain is parallel to the long dimension, and this is why the sheets are 11 by 17, rather than 17 by 11. This paper has a semi-gloss finish, suitable for ink jet color printing. During the puzzle manufacturing process, these sheets are cut down to 14 by 11 for adult puzzles, which can have 200 to 300 pieces. The 3 inch portion of the sheet not cut up into puzzle pieces can be used for generating box labelling, as will be explained. In the case of children's puzzles, the puzzles may be cut to considerably smaller sizes and the puzzle pieces may be cut larger, so that only 30 pieces are cut out. Different puzzle dies are provided which give these different results. The pre-glued surface 59 may be provided with a glue of a type which remains flexible after setting, thereby permitting the puzzles to bend without pieces falling out. The adhesive is preferably pressure sensitive hot melt adhesive.

Figure 5:
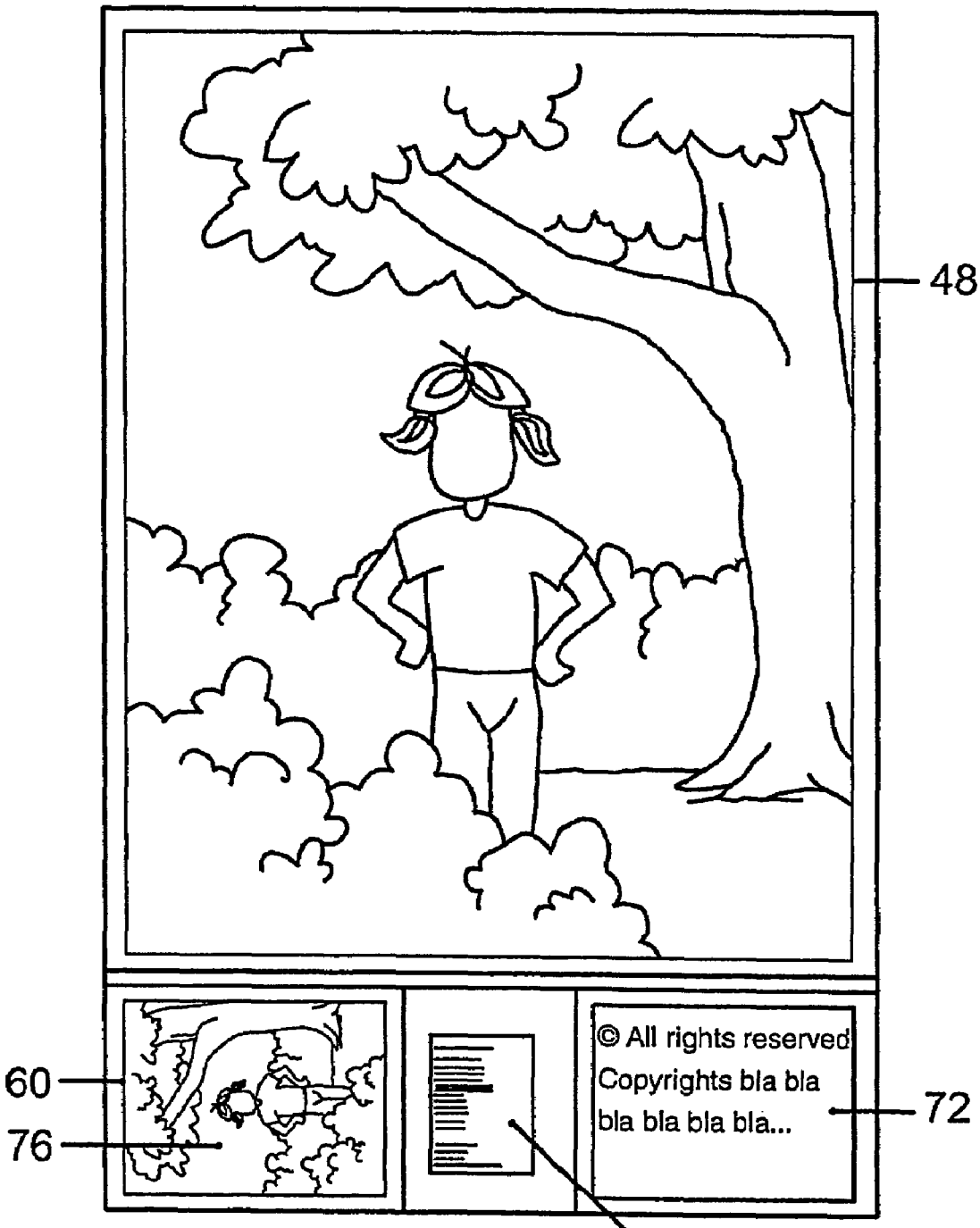
FIG. 5 is a schematic view of a layout of a hard copy printout, according to an embodiment of the invention, printed on flexible paper and including both a puzzle picture and also a smaller picture, a bar code, and licensing information that is to be attached to the box which will contain the puzzle.

Referring now to FIGS. 4, 5, 6, the printing means can be a printer 53 that prints at least one additional, reduced size, copy 60 of the composite image 22 onto the first sheet 48 for use as a customized box label.

Figure 3:
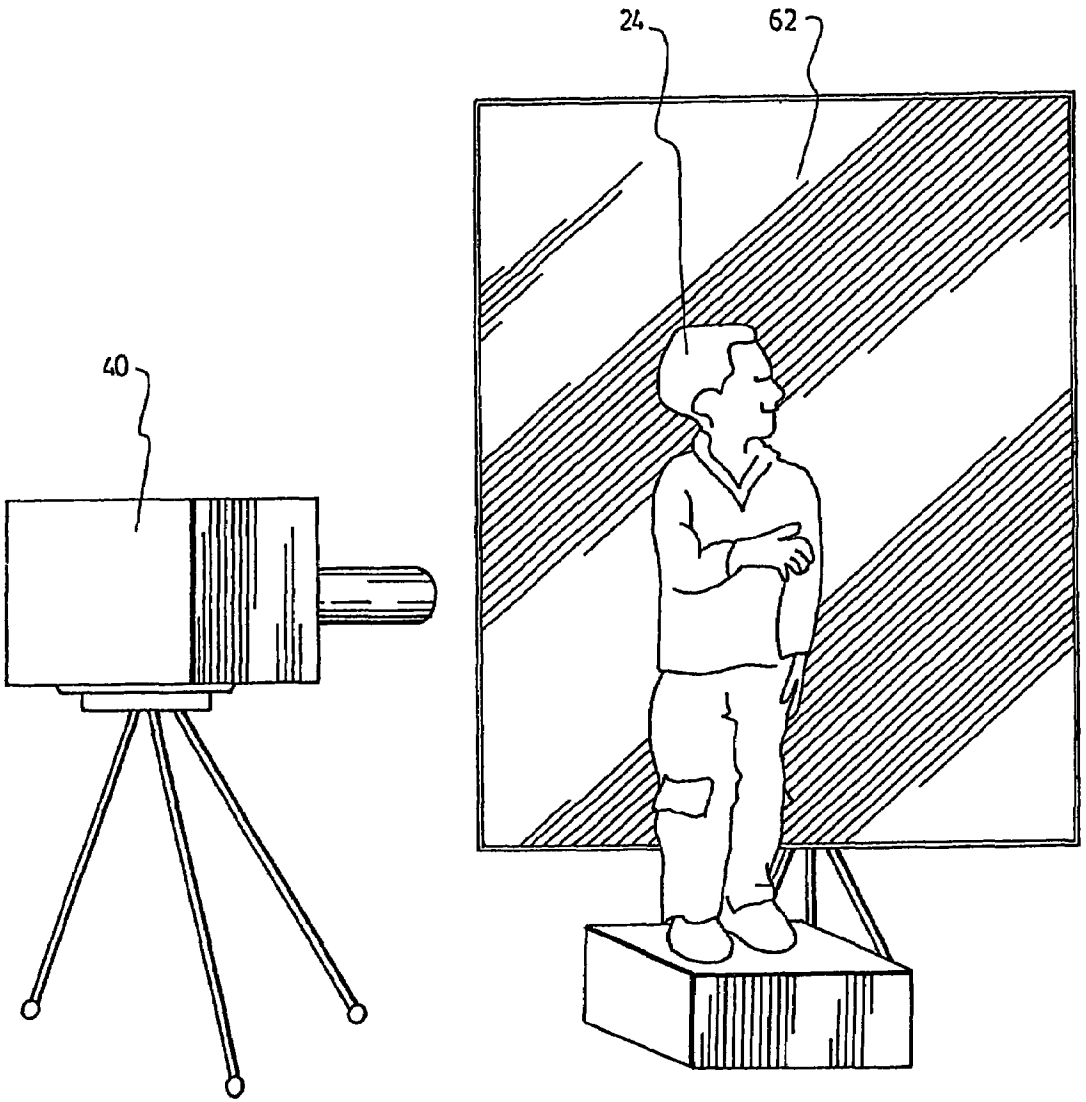
FIG. 3 presents a perspective view of a child being photographed in front of a blue background, according to an embodiment of the invention.

In one embodiment, and referring now to FIGS. 1, 2, and 3, the digital image capturing means 40 comprises a digital camera arranged to capture the second digital image 42 of the person or other subject 24 in front of a uniformly coloured screen 62. A child or person can select the specific image in which the child or person wants to be positioned, as if the child or person or pet or other object (a teddy bear, for example) is part of a scene with a cartoon character or in a movie scene or in any other scenery or image, using a multi-layer digital compositing technique. The machine 20 may include the selecting means 32 that aids the customer in selecting from storage the first digital image 34 which normally contains foreground objects 25 and background scenes 23 and also the image processing means 44 which combines a selected background scene 23 and a foreground object 25 with the second digital image 42 of a person or other object 24, these means being implemented by the programmed computer 43 shown in FIG. 1 as a "Laptop" and also shown in FIG. 13. The display 49 and keyboard and mouse 57 of the computer 43 may be used to grant user approval of the generated composite image 22 for use in designing the custom jigsaw puzzle 30.

The person or other subject 24 may be placed in front of a uniformly coloured screen 62 (usually blue or green) with a defined pre-positioning of the person or other subject 24 so that the subject person 24 seems to interact with the stored image 34 or forms an integral part of the stored image 34. In an embodiment of the invention, a child or a person is photographed in a pre-selected position matching a situation in the stored image 34. A preset process allows a quick and effective photo shoot on the blue screen background 62. Every scene has its own very simple process for capture of the photo. The photo will be taken in a store or shopping mall location or in any other location with public traffic.

In an embodiment of the invention, the selecting means 32 and the image processing means 44 that generate the composite image 22 are implemented by means of a programmed computer 43 (see FIG. 13) which generates the composite image 22, typically a 3-layered digital composite image 22. The computer 43 uses computer programs 41, such as Photoshop™, AdvantEdge™, or any other similar program, to sandwich the image 42 of the person or other object 24 in between the components (typically a background scene 23 and one or more foreground objects 25) or layers of the stored image 34 (the first image) to form the layered composite image 22 which is printed on one of the flexible sheets 55 that forms the upper surface 59 of the custom puzzle 30.

In an embodiment of the invention, a photographer/technician transfers the composite image 22 from the computer 43 to a high resolution printer 53 located within the jigsaw puzzle production means 46. The high resolution printer 53 or a colour photocopier produces a print containing different sections (shown in FIG. 5). These include one bigger size image 22 for use as the face of the puzzle. Also included is a smaller image of the child in the puzzle setting for use as a label for the puzzle box. Additional box label information may be printed out. Thus, if the background scene 23 or any foreground objects 25 are licensed images, the copyright notice and the terms of the license may need to be printed out on the puzzle box. Ant to facilitate the gathering of accounting information to track royalty payments, a UPC bar code 74 may have to be printed out and studied. Note that all image sizes and die-cut jigsaw puzzle sizes are subject to vary and change, depending on the die line of the jigsaw puzzle.

In one embodiment of the invention, the jigsaw puzzle production means 46 provides means for transferring the larger hardcopy version of the composite image 22 and pre-glued foam sheet 50 (shown in FIG. 6) to a press or roller machine. The press's platens 78 and 76 (FIG. 12) may squeeze the puzzle die against the foam sheet 50 and the printed image sheet 48. The puzzle die has a Masonite™ base one-half inch thick into which puzzle grooves are cut, and then metal strips are pushed in to the grooves to do the cutting. A hard rubber pad is then squeezed into the die and cut so that it fills the spaces between the metal strips and enables great force to be applied to the laminated layers. As an alternative to a press, and requiring considerably less force to develop high pressure, a roller 82 may be mounted over the lower platen 78 and die 80. In one arrangement, the platen 78 is mounted on rollers and rolls under the roller 82 which compresses the two sheets together in a manner similar to an old fashioned clothes ringer. Since pressure is applied along a thin line, rather than over a large area all at once, considerably less downward force is needed when the roller 82 is used than when two platens 76 and 78 and a press (not shown) are used.

In one embodiment of the invention, the jigsaw puzzle production means 46 also includes means for affixing on generic packaging for each custom jigsaw puzzle one of the at least one smaller hardcopy version 60 of the composite image 22 on a predetermined location on the packaging, as well as means for inserting the fully die cut jigsaw puzzle pieces into the packaging and means for closing the packaging containing the custom jigsaw puzzle. The technician affixes on generic packaging for each personalized jigsaw puzzle a small copy 60 of the composite image 22 on a predetermined location on the packaging. Other smaller images can also be generated as backups for the packaging, or alternately they may be inserted into the box to serve as a colour reference to facilitate jigsaw puzzle assembly. Any legal information 72, including licence information and copyright notices, any logos and trade-marks 72 related to the use of licensed images in the jigsaw puzzle can also be affixed on a predetermined location on the packaging, as well as a UPC code 74 related to the custom jigsaw puzzle. The technician then inserts the fully die cut jigsaw puzzle pieces into the package which is closed and ready to come out of the jigsaw puzzle production means 46 to be taken home. And as noted above, the bar code allows full automation of the count of each puzzle sold to serve as a basis for royalty payments.

Figure 10:
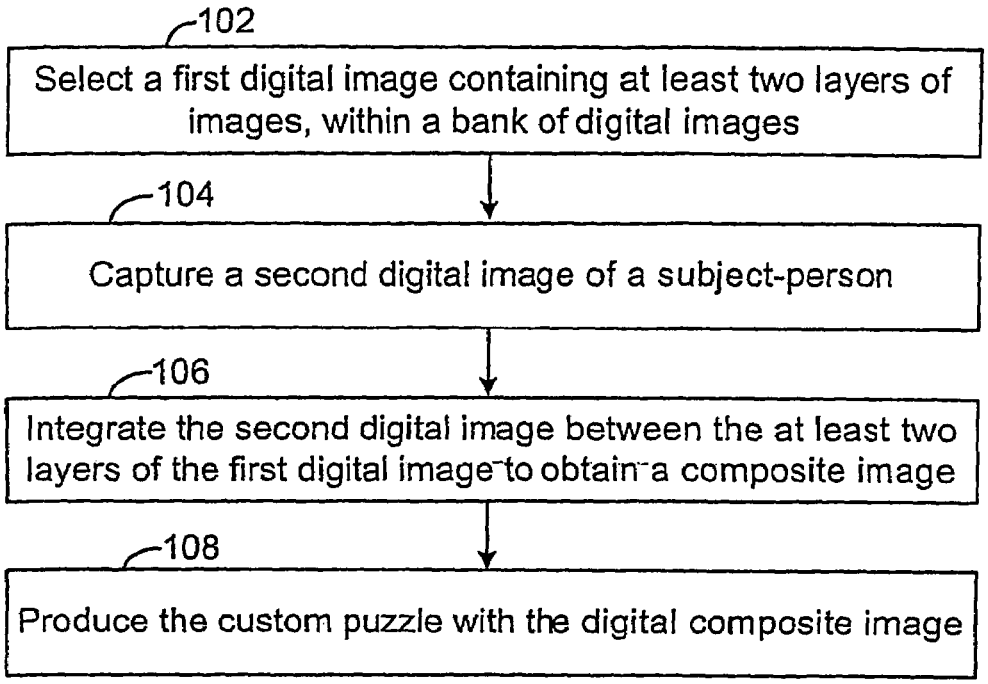
FIG. 10 shows a flow chart illustrating the steps of a method for producing a custom jigsaw puzzle in accordance with one embodiment of the invention.

According to the invention, as shown in FIG. 10, there is provided a method for producing a custom jigsaw puzzle, comprising steps of:

a) selecting 102 a first digital stored image containing at least two layers of images, within a bank of digital images;

b) capturing 104 a second digital image of a person or other subject;

c) integrating 106 the second digital image between the at least two layers of the first digital stored image to obtain a composite image 22; and d) producing 108 the custom jigsaw puzzle with the digital composite image 22.

Step d) can include the steps of:

printing a first copy of the composite image 22 onto a first sheet;

securing the first sheet onto a pre-glued surface 59 of a second sheet made of foam, to obtain a double sheeted member; and die cutting the double sheeted member to obtain the custom jigsaw puzzle.

Step c) can include the step of storing pre-established parameters upon which the integrating is based.

Step c) can further include the steps of displaying the composite image 22 on the display 49 and manipulating the composite image 22.

In step d), the second sheet can be made of a polyethylene foam having a thickness of at least 3 mm.

In step d), the pre-glued surface 59 may be provided with a glue of a type which remains flexible after setting thereof.

In step d), the glue may be pressure sensitive hot melt adhesive.

Step d) can include the step of printing at least one additional copy 60 of the composite image 22 onto the first sheet, the at least one additional copy 60 being smaller than the first copy 22.

In step b), the person or other subject 24 may be positioned in a predetermined position in the second digital image 42 to match a situation determined by the at least two layers of the first digital stored image 34.

Step b) involves capturing a third digital image of another person or other subject, and step c) involves integrating the third digital image between the at least two layers of the first digital stored image within the composite image 22.

Figure 11:
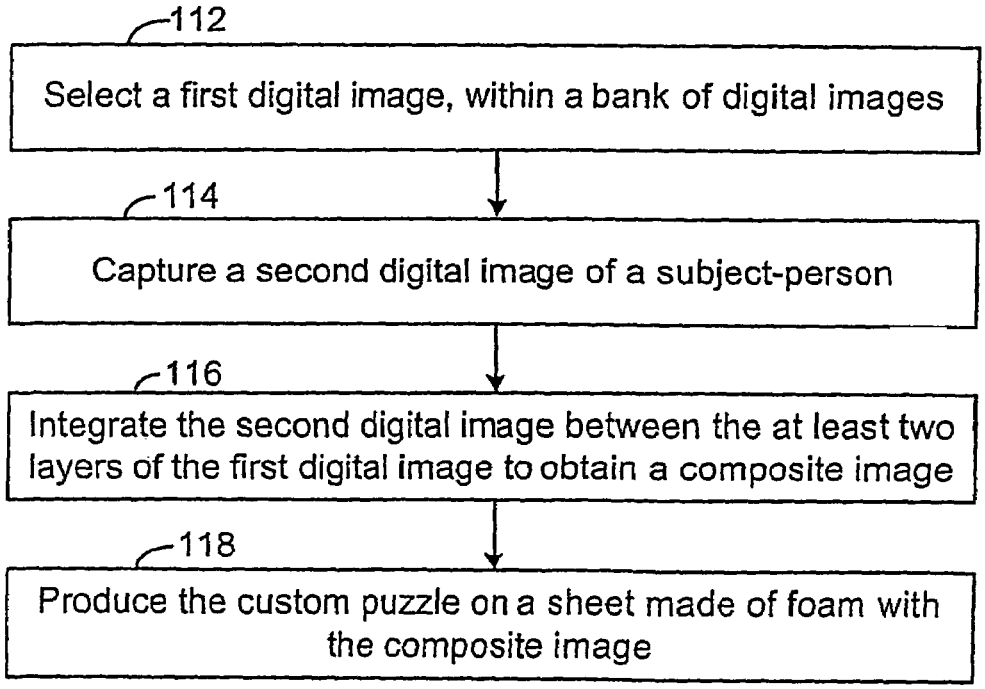
FIG. 11 shows a flow chart illustrating the steps of a method for producing a custom jigsaw puzzle, in accordance with another embodiment of the invention.

According to the invention, as shown in FIG. 11, there is also provided a method for producing a custom jigsaw puzzle, comprising steps of:

a) selecting 112 a first digital stored image, within a bank of digital images;

b) capturing 114 a second digital image of a person or other subject;

c) integrating 116 the second digital image into the first digital stored image to obtain a composite image 22; and d) producing 118 the custom jigsaw puzzle on a sheet made of foam with the composite image 22.

Step d) comprises the steps of:

printing a first copy of the composite image 22 onto a first sheet;

securing the first sheet onto a pre-glued surface 59 of a second sheet made of foam, to obtain a double sheeted member; and die cutting the double sheeted member to obtain the custom jigsaw puzzle.

Step c) may include storing pre-established parameters upon which the integrating is based.

Step c) can involve displaying the composite image 22 on the display 49 and using the keyboard and mouse 57 to manipulate the composite image 22.

In step d), the second sheet is preferably made of a polyethylene foam having a thickness of at least 3 mm., but it may be as thick as ¼ inch or more, particularly for children's puzzles.

In step d), the pre-glued surface 59 is preferably provided with a glue of a type which remains flexible after setting thereof.

In step d), the glue is a pressure sensitive hot melt adhesive.

The step d) can include printing at least one additional copy 60 of the composite image 22 onto the first sheet, the at least one additional copy 60 being smaller than the first copy 22.

In step b), the person or other subject 24 may be placed into a predetermined position in the second digital image 42 to match a situation or scene established by the first digital stored image 34.

Step b) may involve capturing a third digital image of another person or other subject 24, and step c) may then involve integrating this third digital image in with the first two digital images 34 and 42 within the composite image 22.

The production of a custom jigsaw puzzle 30 for a user from a composite image 22 montage combining an image of a person or other subject with at least one stored image (from a variety of stored images offered to a user) may be carried out using the following more detailed sequence of steps:

a) selecting, from a variety of stored images offered to a user, at least one stored image in which the person or other subject is to be positioned;

b) taking a photographic image of the person or other subject in front of a blue screen with a defined pre-positioning of the person or other subject so that such subject person seems to interact with the stored image or forms an integral part of the stored image;

c) generating the image montage including the photographic image of the person or other subject positioned within the at least one stored image;

d) approving the generated image montage for use on the jigsaw puzzle;

e) transferring the image montage to the jigsaw puzzle production means;

f) triggering a start of the production of the jigsaw puzzle;

g) initiating movement of movable parts 54 of external housing of the jigsaw puzzle production unit during production of the jigsaw puzzle;

h) producing at least one larger hardcopy version of the image montage and at least one smaller hardcopy version of the same image montage;

i) applying the larger hardcopy version of the image montage to a pre-glued foam sheet;

j) transferring the larger hardcopy version of the image montage and pre-glued foam sheet to pressing means;

k) gluing the larger hardcopy version of the image montage to the pre-glued foam sheet;

l) die cutting the glued image montage and foam sheet received from the pressing means into jigsaw puzzle pieces;

m) affixing on generic packaging for each custom jigsaw puzzle one of the smaller hardcopy versions of the image montage on a predetermined location on the packaging, as well as a custom UPC code and any appropriate legal data;

n) inserting the fully die cut jigsaw puzzle pieces into the packaging;

o) closing the packaging; and p) providing the custom jigsaw puzzle to the user through an opening in the jigsaw puzzle production unit.

Figure 8:
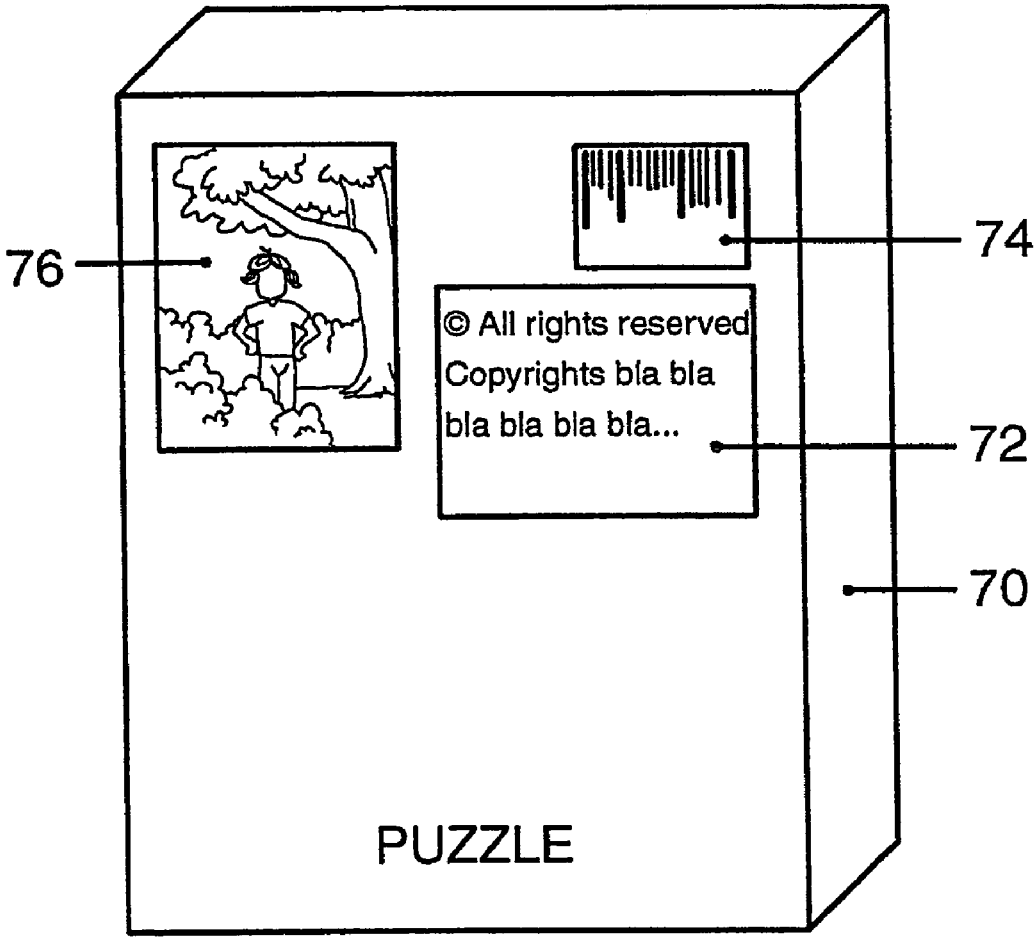
FIG. 8 is a perspective view of custom packaging prepared in accordance with an embodiment of the invention.
Figure 12:
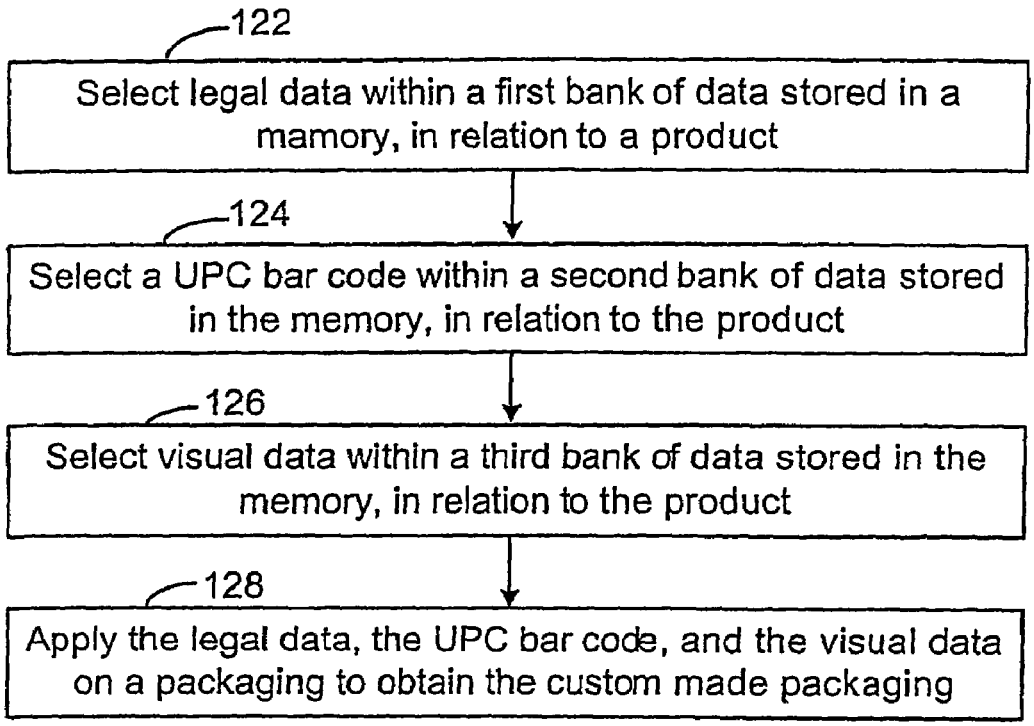
FIG. 12 shows a flow chart illustrating the steps of a method for producing a custom made package in accordance with another aspect of the invention.

Referring now to FIG. 8, another aspect of the custom made packaging 70 is the need to provide a memory, such as the memory 45 of the computer 43 shown in FIG. 12 for storing data. Programming is needed that can select the correct legal data 72 from a first bank of data stored in the memory 45, in relation to a specific product, and also select the proper UPC bar code 74 from those stored within a second bank of data stored in the memory 45. This ties in with the means for selecting visual data 60 which determines which royalty information is applicable and which bar code corresponds to the selected background scene and foreground objects, and a reduced size version of the visual data is included on the label. Thus, a third bank of data stored in the memory 45 is needed. And of course means are required for applying the legal data 72, the UPC bar code 74 and the visual data 60 onto a generic package to produce the custom made packaging 70.

The means for selecting can be the computer 43 provided with a display 49 and with a keyboard and mouse 57, as is shown in FIG. 13.

The first bank of data is data chosen within the group including license data, copyright data, logo data and trademark data.

The third bank of data includes the composite images 22 including a person or other subject 24.

The applying means may include the printer 53 which prints the legal data 72, the UPC bar code 74 and the visual data 60 on stickers that can be applied on the generic packaging. As illustrated in FIG. 5, these may be printed on a portion of the same first flexible sheet 48 on which the puzzle's composite image 22 is printed and cut off to form labels by the puzzle cutting die 80, as is illustrated schematically in FIG. 13.

In one embodiment of the invention, the apparatus for producing a custom made packaging can be used in conjunction with the jigsaw puzzle machine described above, in order to produce a custom made packaging wherein the visual data 60 on the packaging corresponds to the composite image 22 shown on the custom jigsaw puzzle. The legal data in this case will be any legal information (copyright, licenses, logo, trademark or others) related to licensed images used in the composite image 22. The UPC code is related to the type of custom jigsaw puzzle produced and to the imagery used in the composite image 22, to ensure proper tracking of inventory and sales of products.

Referring now to FIG. 12 a method for producing the custom made packaging is described in that figure and below, involving a number of basic steps to which may a plurality of optional steps may be added, as is explained below. According to the invention, there is provided a method for producing a custom made packaging, comprising steps of:

a) selecting 122 legal data within a first bank of data stored in a memory, in relation to a product;

b) selecting 124 a UPC bar code within a second bank of data stored in the memory, in relation to the product;

c) selecting 126 visual data 60 within a third bank of data stored in the memory, in relation to the product; and d) applying 128 the legal data, the UPC bar code and the visual data 60 on a packaging to obtain the custom made packaging.

The steps a), b) and c) are performed by means of the computer 43 which is provided with a display 49 and with a keyboard and a mouse 57.

In step a), the first bank of data can be data chosen within the group including license data, copyright data, logo data and trademark data.

In step c), the third bank of data is the composite image 22 including a person or other subject.

The step d) includes printing the legal data 72, the UPC bar code 74, and the visual data 60 on stickers to be applied on the generic packaging. Alternatively, this step can include printing the legal data 72, the UPC bar code 74 and the visual data 60 on the generic packaging.

Although just a few embodiments of the invention have been described, it should be understood that the invention is not limited to these precise embodiments, and that various changes and modifications may be made without departing from the scope or spirit of the invention as set forth in the claims annexed to and forming a part of this specification.

What is claimed is:

1. An apparatus for producing a customized jigsaw puzzle, comprising:

an image capturing mechanism that captures one or more images of one or more individuals, animals, or objects or combinations of these posed against a background;

a printer;

a supply of flexible sheets having a printable surface;

a computer linked to the image capturing mechanism and printer, and programmed to print an image on a flexible sheet;

a supply of foam sheets thicker and more rigid than the flexible sheets;

a pressure responsive adhesive material; and a press having a platen that carries a jigsaw puzzle cutting die, the press when activated using pressure to laminate the flexible sheet bearing the printed image and the foam sheet together and to set the adhesive material used as a binder to form a laminated product, and substantially simultaneously to cut the laminated product into jigsaw puzzle pieces which further comprises an external housing to cover the printer and press, the housing having an exit and a puzzle conveyor which can convey a customized jigsaw puzzle from inside the housing to the outside.

2. The apparatus of claim 1, comprising a memory containing information defining scenes or objects, wherein the computer is linked to the image capturing mechanism, memory, and printer and programmed to replace an image's background or foreground or both with information taken from one or more scenes or objects to form and then to print a customized image on the flexible sheet.

3. The apparatus of claim 2, wherein the image capturing mechanism comprises a digital camera and a background between which persons, animals, or objects or combinations of these can be posed and then photographed using the camera, the background's color being such that the computer may readily digitally erase the background from images captured by the camera and replace the image background with one or more scenes or objects selected from the memory.

4. The apparatus of claim 1 wherein the image capturing apparatus comprises a digital camera.

5. The apparatus of claim 1 wherein the image capturing mechanism comprises a scanner which can scan and digitally capture an image from at least one photograph.

6. The apparatus of claim 1 wherein the image capturing mechanism comprises a digital information port designed to accept digital information.

7. The apparatus of claim 1, the foam sheets are pre-coated with the adhesive material applied thermally to each of the sheets of the supply of foam sheets.

8. The apparatus of claim 1, wherein the adhesive material is tacky prior to the application of pressure, and wherein the pre-coated foam sheets are stacked and held together by the tackiness of the adhesive material in a breakable bond prior to separation and lamination.

9. The apparatus of claim 1, wherein the jigsaw puzzle cutting die has cutting edges shaped to form complementary interlocking joints between the puzzle pieces and wherein the glue remains substantially flexible after setting such that the jigsaw puzzle is capable of being bent without its pieces detaching themselves from the puzzle.

10. The apparatus of claim 1 wherein a display is attached to the computer, and wherein the computer is programmed to display trial versions of the customized image and includes controls enabling an operator to rearrange elements of the customized image.

11. The apparatus of claim 1 wherein the foam sheets have a thickness of at least 3 millimeters.

12. The apparatus of claim 1 wherein the computer is programmed to print on a second flexible sheet information that may be placed on the outside of a box that is to contain the puzzle.

* * * * *